US008894178B2

(12) United States Patent
Kim et al.

(10) Patent No.: US 8,894,178 B2
(45) Date of Patent: Nov. 25, 2014

(54) ERROR DETECTION APPARATUS OF INKJET PRINTER HEAD AND ERROR DETECTION METHOD THEREOF

(75) Inventors: Byung Hun Kim, Gyeonggi-do (KR); Na Rae Park, Seoul (KR); Hyun Ho Shin, Gyeonggi-do (KR)

(73) Assignee: Samsung Electro-Mechanics Co., Ltd., Suwon, Gyunggi-Do (KR)

( * ) Notice: Subject to any disclaimer, the term of this patent is extended or adjusted under 35 U.S.C. 154(b) by 208 days.

(21) Appl. No.: 13/165,285

(22) Filed: Jun. 21, 2011

(65) Prior Publication Data

US 2012/0206532 A1 Aug. 16, 2012

(30) Foreign Application Priority Data

Feb. 15, 2011 (KR) ..... 10-2011-0013292

(51) Int. Cl.

| | |
|---|---|
| ***B41J 29/393*** | (2006.01) |
| ***B41J 2/165*** | (2006.01) |
| ***B41J 2/045*** | (2006.01) |
| ***B41J 2/21*** | (2006.01) |

(52) U.S. Cl.

CPC ..... *B41J 2/0459* (2013.01); *B41J 2/16579* (2013.01); *B41J 2/0451* (2013.01); *B41J 2/04581* (2013.01); *B41J 2/2142* (2013.01)

USPC ..... 347/19

(58) Field of Classification Search

USPC ..... 347/19

See application file for complete search history.

(56) References Cited

U.S. PATENT DOCUMENTS

| | | | | |
|---|---|---|---|---|
| 7,566,109 | B2 * | 7/2009 | Shinkawa et al. | 347/19 |
| 2006/0038858 | A1 * | 2/2006 | Ishizaki | 347/68 |

FOREIGN PATENT DOCUMENTS

| | | | |
|---|---|---|---|
| JP | 2004-299140 | A | 10/2004 |
| JP | 2005-305992 | A | 11/2005 |
| JP | 2006-218727 | A | 8/2006 |
| JP | 2007-152890 | A | 6/2007 |
| JP | 2007-157890 | A | 6/2007 |
| JP | 2007-326237 | | 12/2007 |
| JP | 2007-326237 | A | 12/2007 |
| KR | 20-1998-0016579 | | 6/1998 |
| KR | 10-2004-0077568 | | 8/2004 |

OTHER PUBLICATIONS

Office Action issued in Japanese Patent Application No. 2011-206875 dated Feb. 26, 2013.

Korean Notice of Allowance issued in Application No. 10-2011-0013292 dated Jun. 3, 2013.

Japanese Office Action issued in Japanese Application No. 2013-109803 dated Jun. 17, 2014.

* cited by examiner

*Primary Examiner* — Julian Huffman

(74) *Attorney, Agent, or Firm* — McDermott Will & Emery LLP

(57) ABSTRACT

Provided is an error detection apparatus of an inkjet printer head including: an amplification unit connected between a piezoelectric element, which applies pressure to an ink chamber, and a ground to amplify a voltage generated from the piezoelectric element; and a detection unit for detecting whether ink is normally ejected using the voltage amplified by the amplification unit. It is possible to detect whether the inkjet printer head abnormally ejects ink by sensing vibration after ejection of ink using the piezoelectric element.

4 Claims, 5 Drawing Sheets

FIG. 2A

ERROR DETECTION APPARATUS OF INKJET PRINTER HEAD AND ERROR DETECTION METHOD THEREOF

CROSS-REFERENCE TO RELATED APPLICATIONS

Claim and incorporate by reference domestic priority application and foreign priority application as follows:

CROSS-REFERENCE TO RELATED APPLICATION

This application claims the benefit under 35 U.S.C. Section 119 of Korean Patent Application Serial No. 10-2011-0013292, entitled filed Feb. 15, 2011, which is hereby incorporated by reference in its entirety into this application.

BACKGROUND OF THE INVENTION

1. Field of the Invention

The present invention relates to an error detection apparatus of an inkjet printer head, and more particularly, to an error detection apparatus of an inkjet printer head capable of detecting whether an inkjet printer head abnormally ejects ink, and an error detection method thereof.

2. Description of the Related Art

An inkjet printer performs printing by spraying small ink drops on paper through a nozzle of an inkjet printer head and consists of a pressure chamber, a nozzle, a passage, and a piezoelectric actuator for generating a driving pressure.

Among them, generally, the piezoelectric actuator is closely adhered around the pressure chamber, and droplets are ejected from the nozzle by a pressure generated in the pressure chamber due to a displacement change of the piezoelectric actuator to which an electrical signal is applied.

However, since the nozzle part of the inkjet printer head is exposed to air, there is a problem that air is likely to be introduced into the inkjet printer head on a contact surface with ink, and this introduced air greatly reduces the pressure generated by the piezoelectric actuator so that the ejection of the droplets from the nozzle may be stopped.

As described above, when abnormal ejection occurs in the inkjet printer head, since the quality of printed circuit board may be greatly affected, the need to quickly detect the nozzle from which ink is abnormally ejected has increased.

SUMMARY OF THE INVENTION

The present invention has been invented in order to overcome the above-described problems and it is, therefore, an object of the present invention to provide an error detection apparatus of an inkjet printer head capable of detecting whether an inkjet printer head abnormally ejects ink by detecting vibration after ejection of ink using a piezoelectric element, and an error detection method thereof.

In accordance with one aspect of the present invention to achieve the object, there is provided an error detection apparatus of an inkjet printer head including: an amplification unit connected between a piezoelectric element, which applies pressure to an ink chamber, and a ground to amplify a voltage generated from the piezoelectric element; and a detection unit for detecting whether ink is normally ejected using the voltage amplified by the amplification unit.

Here, the detection unit compares the voltage amplified by the amplification unit with a pre-stored reference voltage during normal ejection.

At this time, the detection unit detects that ink is normally ejected from a nozzle when the voltage amplified by the amplification unit is equal to the reference voltage during normal ejection in the comparison result.

And the detection unit detects that ink is abnormally ejected from the nozzle when the voltage amplified by the amplification unit is not equal to the reference voltage during normal ejection in the comparison result.

Further, the detection unit stores a number of the nozzle from which ink is abnormally ejected.

In addition, the detection unit stores the result of detecting whether ink is normally ejected at predetermined time intervals.

Meanwhile, in accordance with another aspect of the present invention to achieve the object, there is provided an error detection apparatus of an inkjet printer head including: a driving unit for generating a plurality of driving signals corresponding to a plurality of nozzles to eject ink through the plurality of nozzles; a piezoelectric element for applying pressure to an ink chamber according to the driving signal; an amplification unit for amplifying a voltage generated from the piezoelectric element; a detection unit for detecting whether ink is normally ejected using the voltage amplified by the amplification unit; and a switching unit turned on or off to selectively transmit the voltage generated from the piezoelectric element to the amplification unit.

Here, the detection unit detects whether ink is normally ejected by comparing the voltage amplified by the amplification unit with a pre-stored voltage of the amplification unit during normal ejection.

More specifically, the detection unit detects that ink is normally ejected from the nozzle when the voltage amplified by the amplification unit is equal to the voltage of the amplification unit during normal ejection in the comparison result.

Contrary to this, the detection unit detects that ink is abnormally ejected from the nozzle when the voltage amplified by the amplification unit is not equal to the voltage of the amplification unit during normal ejection in the comparison result.

Further, the detection unit stores a number of the nozzle from which ink is abnormally ejected.

In addition, the detection unit stores the result of detecting whether ink is normally ejected at predetermined time intervals.

Besides, the detection unit detects whether ink is normally ejected using the voltage amplified by the amplification unit after the piezoelectric element is driven according to the driving signal.

Meanwhile, in accordance with still another aspect of the present invention to achieve the object, there is provided an error detection method of an inkjet printer head including: a driving step of generating and outputting a plurality of driving signals corresponding to a plurality of nozzles to eject ink through the nozzles provided in the inkjet printer head; a detection step of driving a piezoelectric element according to the driving signal and detecting and storing a voltage generated from the piezoelectric element; and a determination step of determining whether ink is normally ejected by determining whether the detection operation is completed with respect to the plurality of nozzles and comparing the stored voltage with a pre-stored reference voltage during normal ejection when the detection operation is completed.

Here, the determination step determines whether ink is normally ejected by amplifying the stored voltage and comparing the amplified voltage with the pre-stored reference voltage during normal ejection.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERABLE EMBODIMENTS

The terms or words used in the present specification and claims should not be interpreted as being limited to typical or dictionary meanings, but should be interpreted as having meanings and concepts relevant to the technical spirit of the present invention based on the rule according to which an inventor can appropriately define the concept of the term to describe his/her own invention in the best manner.

Therefore, configurations shown in embodiments and the drawings of the present invention rather are examples of the most exemplary embodiment and do not represent all of the technical spirit of the invention. Thus, it will be understood that various equivalents and modifications that replace the configurations are possible when filing the present application.

Hereinafter, embodiments of the present invention will be described in detail with reference to the accompanying drawings.

Figure 1:
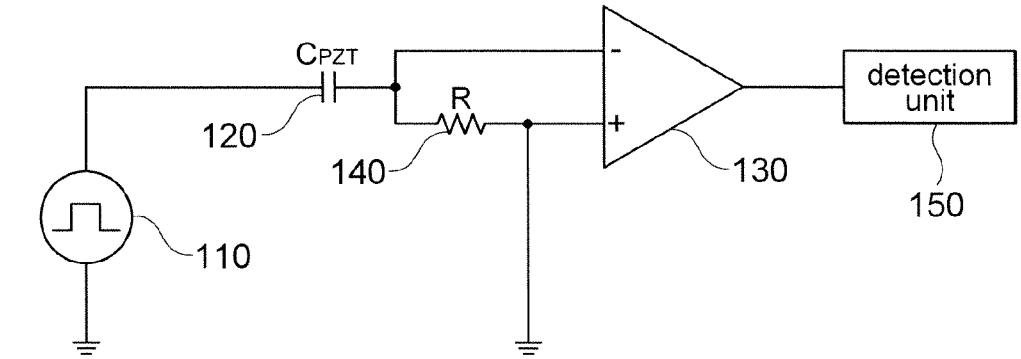
FIG. 1 is a configuration diagram of an error detection apparatus of an inkjet printer head in accordance with an embodiment of the present invention.

FIG. 1 is a configuration diagram of an error detection apparatus of an inkjet printer head in accordance with an embodiment of the present invention.

As shown in FIG. 1, an error detection apparatus 100 of an inkjet printer head includes a driving unit 110, a piezoelectric element 120, an amplification unit 130, a resistor 140, and a detection unit 150.

The driving unit 110 generates and outputs a driving signal for driving the piezoelectric element 120.

The piezoelectric element 120 is provided in each nozzle of an inkjet printer head and converts the electrical driving signal applied from the driving unit 110 into mechanical energy to generate a pressure in an ink chamber of each nozzle so that ink is ejected from the nozzle.

Further, contrary to converting electrical energy (that is, electrical driving signal) into mechanical energy during ejection of ink described above, the piezoelectric element 120 can convert mechanical energy into electrical energy.

Accordingly, when residual vibration after ejection of ink is applied to the piezoelectric element 120, the piezoelectric element 120 outputs the residual vibration as an electrical signal and thus it is possible to use the piezoelectric element 120, which is used as a piezoelectric actuator, as a sensor for determining whether ink is abnormally ejected by sensing the vibration after the ejection of ink.

And, since electrical characteristics of the piezoelectric element 120 are similar to those of a capacitive element when being configured with a circuit, it is shown as a capacitor $C_{PZT}$ in FIG. 1.

An inverting input terminal ((−) input terminal) of the amplification unit 130 is connected to the piezoelectric element 120, and a non-inverting input terminal ((+) input terminal) is connected to a ground GND. And the resistor 140 for current sensing is connected between the piezoelectric element 120 and the ground GND.

Meanwhile, the error detection apparatus of an inkjet printer head in accordance with an embodiment of the present invention may further include a resistance element (not shown) connected to the inverting input terminal of the amplification unit 130. At this time, it is preferred that resistance of the resistor 140 connected to the non-inverting input terminal of the amplification unit 130 is set equal to that of the resistance element (not shown) connected to the inverting input terminal.

And the amplification unit 130 amplifies a voltage generated from the piezoelectric element 120 to transmit the amplified voltage to the detection unit 150. The reason for amplifying the voltage generated from the piezoelectric element 120 is that the electrical signal generated from the piezoelectric element 120 by the residual vibration after the ejection of ink is very small in comparison with the electrical signal output from the driving unit 110.

The detection unit 150 detects whether ink is normally ejected from the nozzle by analyzing the voltage generated from the piezoelectric element 120, which is amplified by the amplification unit 130.

When explaining in more detail, the detection unit 150 receives the output signal, that is, the voltage generated from the piezoelectric element 120, which is amplified by the amplification unit 130, compares the output signal with a pre-stored reference output signal during normal ejection, and determines that the corresponding nozzle is a nozzle from which ink is abnormally ejected when the two output signals are not equal to each other in the comparison result. And the detection unit 150 determines that the corresponding nozzle is a nozzle from which ink is normally ejected when the two output signals are equal to each other in the comparison result.

Further, the detection unit 150 is configured to store whether ink is normally ejected at predetermined time intervals. As above, the detection unit 150 controls the result of detecting whether ink is normally ejected to be displayed through a predetermined screen display means by storing whether ink is normally ejected at predetermined time intervals.

Figure 2A:
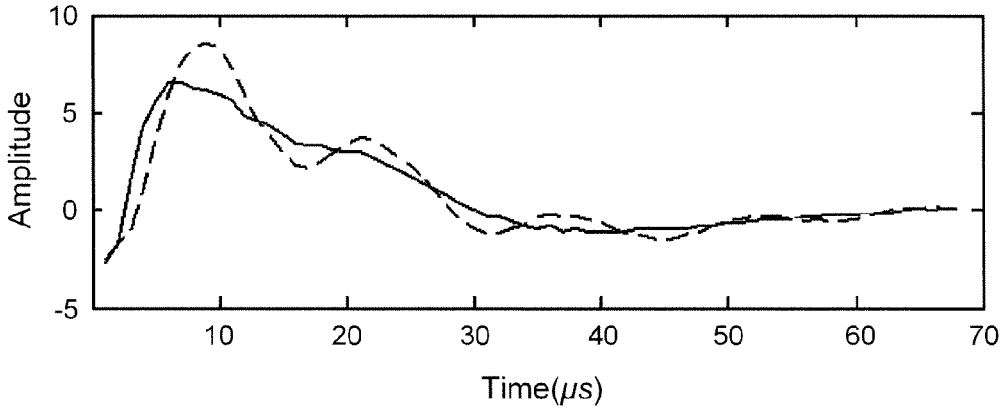
FIGS. 2*a* and 2*b* are graphs comparing signals output from an amplification unit of the error detection apparatus of an inkjet printer head in accordance with an embodiment of the present invention during normal ejection and abnormal ejection.
Figure 2B:
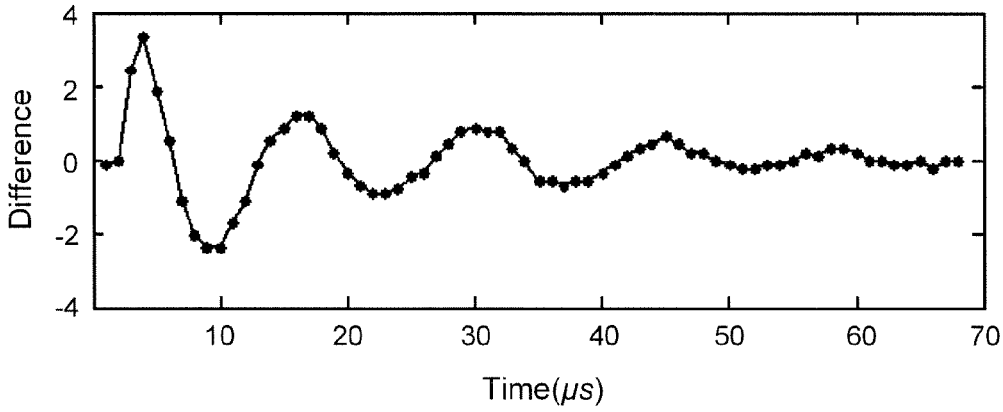
Figure 3A:
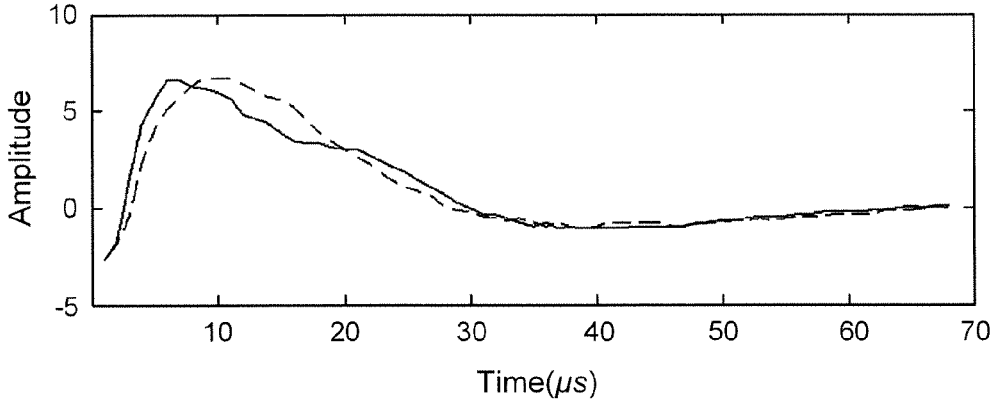
FIGS. 3*a* and 3*b* are graphs comparing signals output from an amplification unit of an error detection apparatus of an inkjet printer head in accordance with another embodiment of the present invention during normal ejection and abnormal ejection.
Figure 3B:
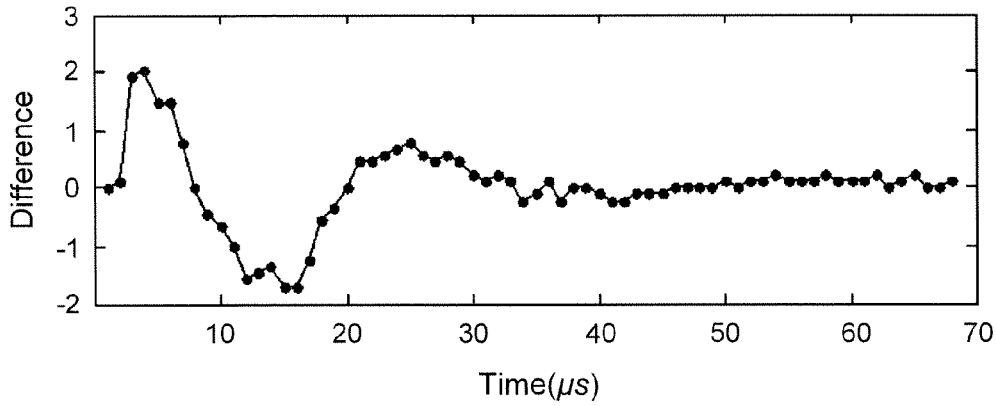

FIGS. 2*a* and 2*b* are graphs comparing the signals output from the amplification unit of the error detection apparatus of an inkjet printer head in accordance with an embodiment of the present invention during normal ejection and abnormal ejection. FIGS. 3*a* and 3*b* are graphs comparing signals output from an amplification unit of an error detection apparatus of an inkjet printer head in accordance with another embodiment of the present invention.

Specifically, a solid line and a dotted line of the graph of FIG. 2*a* show outputs during normal ejection and abnormal ejection, respectively, and FIG. 2*b* shows a difference between the two outputs shown in FIG. 2*a*.

For more accurate determination, when a signal obtained by subtracting the output signal applied from the amplification unit 130 from the reference output signal during normal ejection is equal to the signal shown in FIG. 2*b*, the detection unit 150 determines the corresponding nozzle as a nozzle from which ink is abnormally ejected. At this time, the signal of the graph of FIG. 2*b* may be pre-stored in the detection unit 150.

Referring to FIG. 3, similarly, a solid line and a dotted line of the graph of FIG. 3*a* show outputs during normal ejection and abnormal ejection, respectively, and FIG. 3*b* shows a difference between the two outputs shown in FIG. 3*a*.

At this time, FIG. 2 shows the case in which abnormal ejection occurs due to introduction of air from a contact surface between air and ink of the nozzle part, and FIG. 3 shows that case in which abnormal ejection occurs due to blocking of a nozzle surface by ink and foreign substances.

Figure 4:
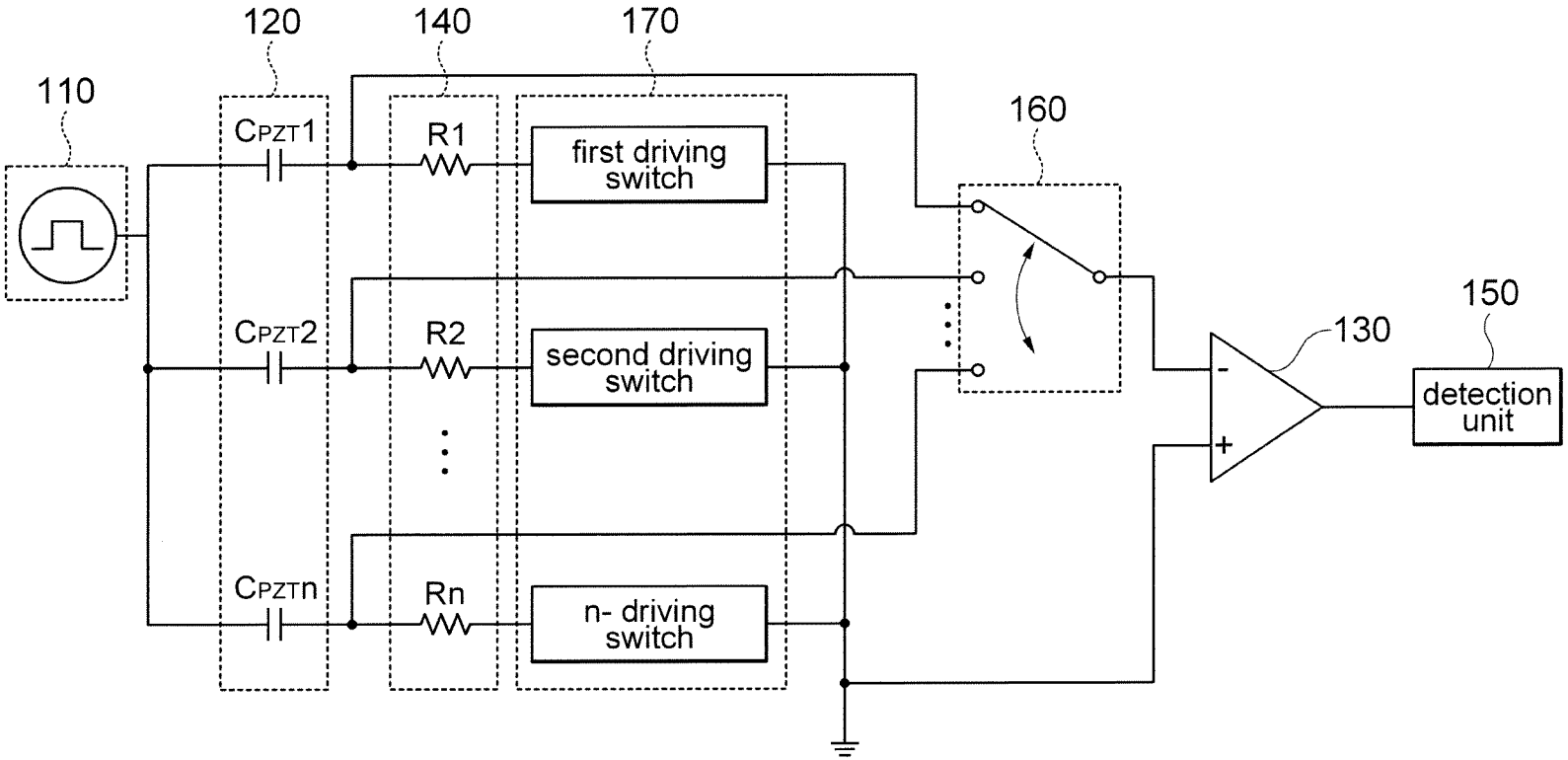
FIG. 4 is a configuration diagram of the error detection apparatus of an inkjet printer head in accordance with another embodiment of the present invention.

FIG. 4 shows a configuration diagram of an error detection apparatus of an inkjet printer head in accordance with another embodiment of the present invention.

As shown in FIG. 4, in order to be applied to an inkjet printer head having a plurality of nozzles, an error detection apparatus 100 of an inkjet printer head includes a driving unit 110, a piezoelectric element 120, an amplification unit 130, a resistor 140, a detection unit 150, a switching unit 160, and a driving switch 170.

The driving unit 110 generates and outputs a plurality of driving signals for driving the plurality of nozzles, that is, the plurality of piezoelectric elements 120.

The piezoelectric element 120 is provided in each nozzle of the inkjet printer head and converts the electrical driving signal applied from the driving unit 110 into mechanical energy to generate a pressure in an ink chamber of each nozzle so that ink is ejected from the nozzle.

An inverting input terminal ((−) input terminal) of the amplification unit 130 is connected between the piezoelectric element 120 and the resistor 140, and a non-inverting input terminal ((+) input terminal) is connected to a ground GND. And the resistor 140 for current sensing is connected between the piezoelectric element 120 and the ground GND.

And the amplification unit 130 amplifies a voltage generated from the piezoelectric element 120 to transmit the amplified voltage to the detection unit 150. The reason for amplifying the voltage generated from the piezoelectric element 120 is that the electrical signal generated from the piezoelectric element 120 by residual vibration after ejection of ink is very small in comparison with the electrical signal output from the driving unit 110.

The detection unit 150 detects whether ink is normally ejected from the nozzle by analyzing the voltage generated from the piezoelectric element 120, which is amplified by the amplification unit 130.

When explaining in more detail, the detection unit 150 receives the output signal, that is, the voltage generated from the piezoelectric element 120, which is amplified by the amplification unit 130, compares the output signal with a pre-stored reference signal during normal ejection, and determines that the corresponding nozzle is a nozzle from which ink is abnormally ejected when the two output signals are not equal to each other in the comparison result. And the detection unit 150 detects whether abnormal ejection occurs by scanning outputs for other nozzles after storing a number of the nozzle from which ink is abnormally ejected. When the detection of abnormal ejection with respect to the plurality of nozzles is completed by repeating the above process, the detection unit 150 controls the number of the nozzle from which ink is abnormally ejected to be displayed through a predetermined screen display means.

The switching unit 160 is turned on or off to selectively transmit the voltage generated from the piezoelectric element 120 to the amplification unit 130.

That is, it is possible to sequentially detect from which nozzle is ink abnormally ejected by connecting the switching unit 160 to the inverting input terminal ((−) input terminal) of the amplification unit 130 to sequentially scan the outputs for the plurality of nozzles.

The driving switch 170 is turned on or off to control driving of the piezoelectric element 120 in response to the driving signal output from the driving unit 110. That is, when the driving switch 170 is turned on, the piezoelectric element 120 is also turned on. When the driving switch 170 is turned off, the piezoelectric element 120 is also turned off.

Figure 5:
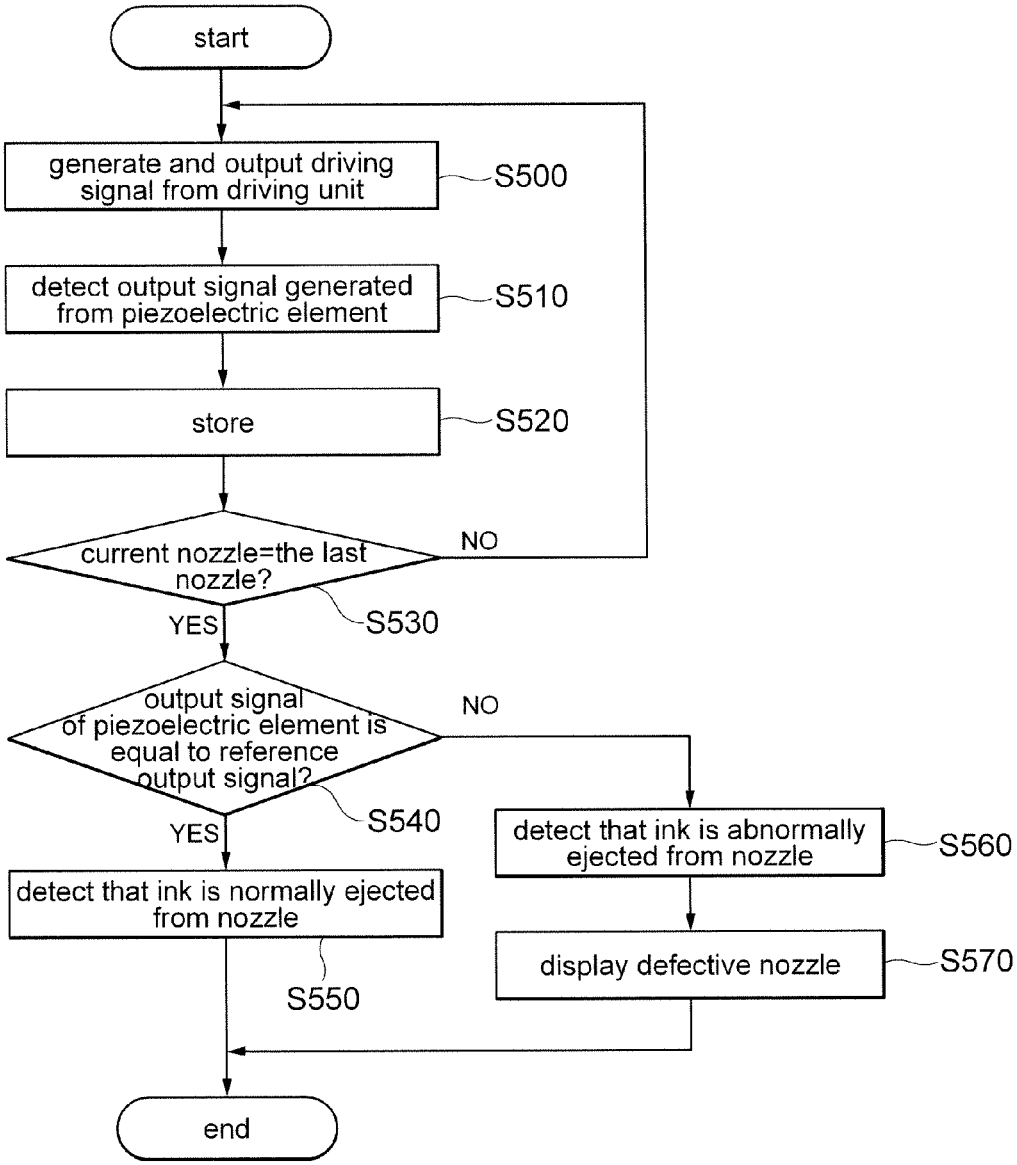
FIG. 5 is an operation flow chart showing a process of detecting an error state of the error detection apparatus in accordance with an embodiment of the present invention.
Figure 6:
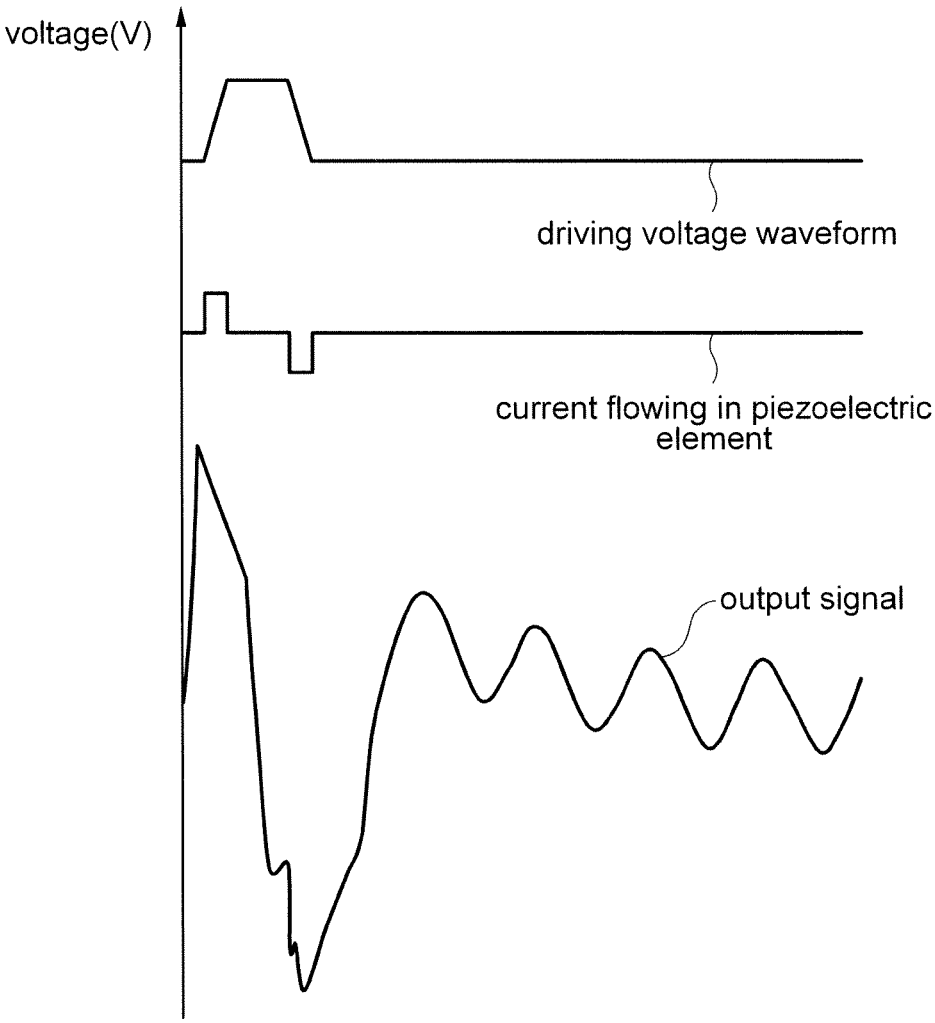
FIG. 6 is a graph showing an operation waveform for detecting the error state of the error detection apparatus in accordance with an embodiment of the present invention.

FIG. 5 is an operation flow chart showing a process of detecting an error state of an inkjet printer head in accordance with an embodiment of the present invention, and FIG. 6 is a graph showing an operation waveform for detecting the error state of an inkjet printer head in accordance with an embodiment of the present invention.

Referring to FIGS. 5 and 6, a plurality of driving signals corresponding to a plurality of nozzles are generated and output in order to eject ink through the nozzles provided in an inkjet printer head (S500).

And then a piezoelectric element 120 is driven according to the driving signal and a voltage generated from the piezoelectric element 120 is detected and stored (S510 and S520).

As shown in FIG. 6, when the driving voltage waveform (driving signal) from the driving unit 110 is applied to the piezoelectric element 120, a current flows in the piezoelectric element 120 like FIG. 6, and an output signal is detected by amplifying a voltage waveform output from the piezoelectric element 120. At this time, the voltage waveform output from the piezoelectric element 120 may be stored at predetermined time intervals for comparison.

And it is checked whether the current nozzle is the last nozzle (S530). The above operation is repeated up to the last nozzle.

After storing the output signals measured up to the last nozzle (that is, determining whether the operation of detecting the output signals generated from the piezoelectric element 120 is completed with respect to the plurality of nozzles (S530), and when the detection operation is completed ('YES' of the step 530)), the detection unit 150 detects whether the nozzle normally ejects ink by comparing the stored output signal with a pre-stored reference output signal during normal ejection (S540).

If the stored output signal is equal to the pre-stored reference output signal during normal ejection ('YES' of the step 540), the detection unit 150 detects that ink is normally ejected from the nozzle (S550).

Contrary to this, when the stored output signal is not equal to the pre-stored reference output signal during normal ejection ('NO' of the step 540), the detection unit 150 detects that ink is abnormally ejected from the nozzle (S560).

Next, the detection unit 150 stores a number of the nozzle detected as abnormal and controls the number of the nozzle detected as abnormal to be displayed on a predetermined screen display means (S570).

As described above, according to an error detection apparatus of an inkjet printer head and an error detection method thereof in accordance with an embodiment of the present invention, there is an advantage that it is possible to simply determine whether ink is normally ejected from a nozzle by amplifying an output generated from a piezoelectric element due to residual vibration after ejection of ink.

Further, there is an advantage that it is possible to reduce the number of contacts to be sensed for each nozzle by connecting one of the two contacts of an amplification unit, which amplifies an output generated from a piezoelectric element to a ground.

Due to this, there are advantages that it is possible to simplify a circuit configuration of an inkjet printer head and to reduce manufacturing cost.

Although the preferable embodiments of the present invention have been shown and described, it will be appreciated by those skilled in the art that substitutions, modifications and variations may be made in these embodiments without departing from the principles and spirit of the general inventive concept, the scope of which is defined in the appended claims and their equivalents.

What is claimed is:

1. An error detection apparatus of an inkjet printer head, comprising:

a piezoelectric element configured to apply pressure to an ink chamber;

an amplification unit configured to amplify a voltage generated from the piezoelectric element, wherein:

an inverting input terminal of the amplification unit is directly connected to the piezoelectric element, a non-inverting input terminal of the amplification unit is directly connected to a ground, and a resistor is connected between the piezoelectric element and the ground; and a detection unit configured to detect whether ink is normally ejected, by comparing the voltage amplified by the amplification unit with a pre-stored reference voltage.

2. The error detection apparatus of an inkjet printer head according to claim 1, wherein:

the detection unit detects that ink is normally ejected from a nozzle when the voltage amplified by the amplification unit is equal to the reference voltage during normal ejection in a result of the comparison, and the detection unit detects that the ink is abnormally ejected from the nozzle when the voltage amplified by the amplification unit is not equal to the reference voltage during normal ejection in the result of the comparison.

3. The error detection apparatus of an inkjet printer head according to claim 2, wherein the detection unit stores a number of nozzles from which ink is abnormally ejected.

4. The error detection apparatus of an inkjet printer head according to claim 1, wherein the detection unit stores a result of detecting whether ink is normally ejected at predetermined time intervals.

* * * * *